US005303874A

United States Patent [19]

Le Masters

[11] Patent Number: 5,303,874

[45] Date of Patent: Apr. 19, 1994

[54] DEVICE FOR ROLLING BED ROLLS

[76] Inventor: Kevin J. Le Masters, 8781 Evergreen Dr., Mentor, Ohio 44060

[21] Appl. No.: 948,242

[22] Filed: Sep. 21, 1992

[51] Int. Cl.[5] ..... B65H 18/00

[52] U.S. Cl. ..... 242/68; 242/67.1 R; 242/96

[58] Field of Search ..... 242/67.1 R, 68, 68.5, 242/96; 222/99, 100

[56] References Cited

U.S. PATENT DOCUMENTS 1,270,188 6/1918 Mochon ..... 242/96
3,533,572 10/1970 Sims ..... 242/68
3,830,442 8/1974 Kubovich et al. ..... 242/68
4,973,009 11/1990 Dunlap ..... 242/68
5,181,670 1/1993 Eaton et al. ..... 242/96
5,186,411 2/1993 Fanning et al. ..... 242/96

*Primary Examiner*—Daniel P. Stodola
*Assistant Examiner*—John Q. Nguyen
*Attorney, Agent, or Firm*—Frank B. Robb

[57] ABSTRACT

A bed roll rolling device which enables a sleeping bag or the like to be tightly rolled up for transport or storage, the device being usable for successive manipulation to roll a succession of such bags, and removable for storage or to handle additional bags in similar fashion.

6 Claims, 1 Drawing Sheet

DEVICE FOR ROLLING BED ROLLS

BACKGROUND OF THE INVENTION

This invention will be understood and appreciated by those who are inclined to clamp or use articles such as sleeping bags or the like including tents to enjoy the camping hobby, that this invention will provide means for making the same portable, lightweight and forming a compact, neat, easily carried bundle by forming the sleeping bags or tents as may be required as made possible hereby.

I do not know that any such device is currently available, it being the broad contemplation hereof to provide a means for rolling a sleeping bag or the like which has been initially positioned and folded in a narrow configuration, so as to be manipulated by my invention and tightly rolled upon itself, by the means provided herein. There is thus made possible not only the removal of the means which are used to effect the rolling action, but to use the same in successive manipulations for rolling successive bags as the case may be as for example where a group of persons are using bags and wish to have them tightly rolled up for transport and camping use.

There is not to my knowledge any available means for effecting this kind of an action and the particular device itself is comprised of elements which are relatively simple and yet make the same flexible enough to not only roll the bags or the like, but to use the same in successive actions of like nature and or to leave the device or means stored within the rolled bag or the like.

With that background in mind, it should be understood that the device hereof is of a simple construction which is readily positioned so as to receive at least one end of the sleeping bag or similar article therein or thereon and by manipulating handles provided roll the same upon itself into a tight package for transport or storage.

The device includes extendable handles which are usable to effect the rolling action and when that is completed to either be pushed inwardly and stored within the rolled part or bag for example or in the alternative the device may be removed and used for successive rolling of sleeping bags or the like.

With that background in mind, the means hereof is shown in the accompanying drawing and set forth in the specification appended hereto, the drawing disclosing in FIG. 1, a generally somewhat diagrammatic view of the device as in position and preparatory to a rolling action of a sleeping bag suitably positioned.

DETAILED DESCRIPTION OF THE INVENTION

Figure 1:
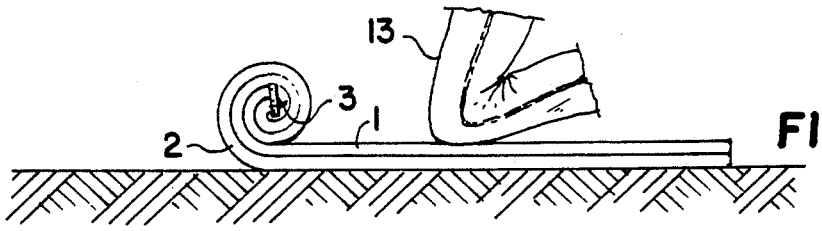

Referring now to FIG. 1, a sleeping bag is shown as being folded in half longitudinally so that it is in the two parts 1 and 2 for illustrative purposes, extending from the partially rolled end 3 thereof on the ground in a position to continue rolling by the device or means hereof.

Figure 2:
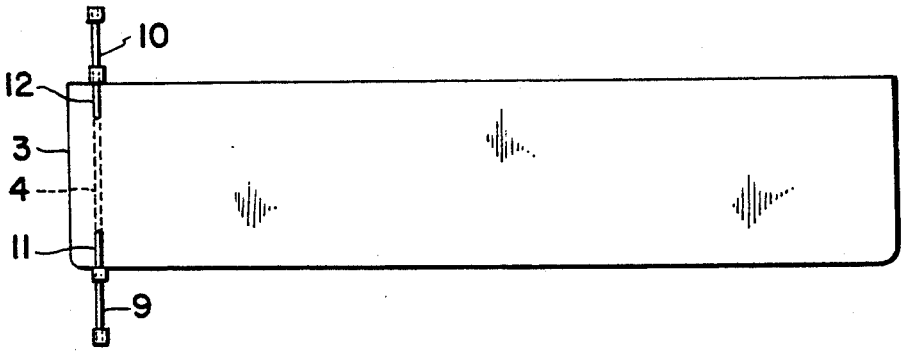
FIG. 2 is a plan view showing the device or means mounted at one end of a sleeping bag as it is folded upon itself so as to provide a reasonably narrow item and thereafter by manipulating of the handles at the end effect the rolling action.

Thereafter as suggested in FIG. 2, the device is positioned as shown so that certain fingers are in their appropriate positions for the rolling action.

Figure 3:
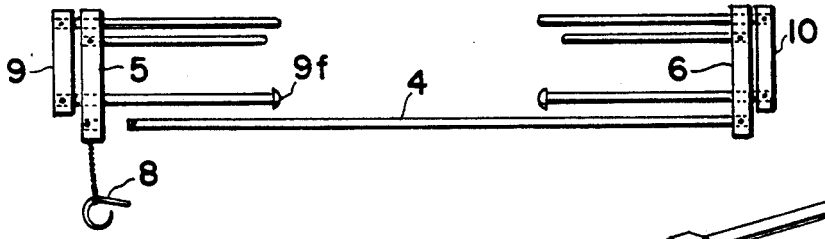
FIG. 3 is what may be called a side view of the device showing the various elements in their relationship with one another.

It is desirable at this point to describe the means in detail and FIG. 3 is availed of for that purpose showing a main spacer bar or rod 4 which is provided at its ends with certain finger supports 5 and 6, these being identical for the purposes hereof.

The supports 5 and 6 are suitably engaged with the bar 4 at the support 6 by means of a pin 7 suitably positioned so as to prevent relative rotation of the bar with respect to the support 6.

Figure 4:
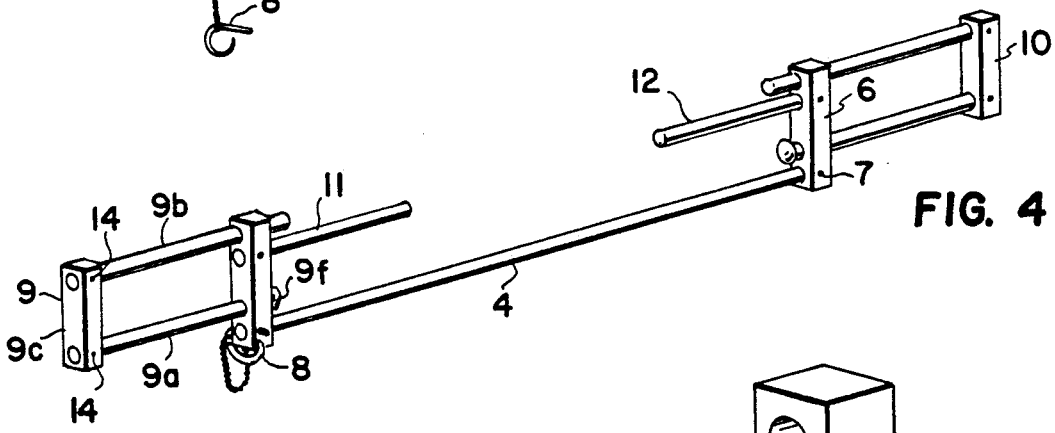
FIG. 4 is a perspective view of the disclosure of FIG. 3.
Figure 5:
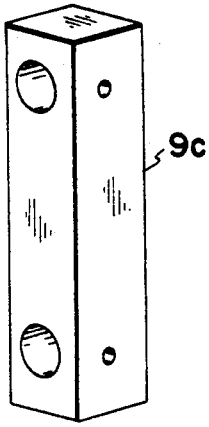
FIGS. 5 and 6 are parts which are used in constructing the means hereof, the parts being shown in perspective.
Figure 6:
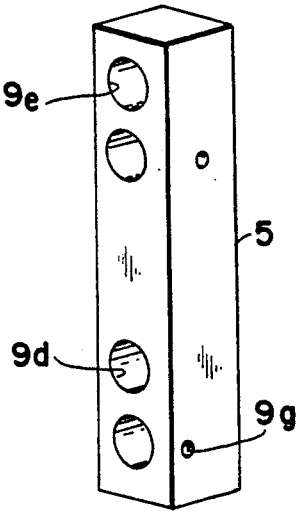

At the support 5, the bar is connected by a suitable hairpin so called denoted 8 and more particularly shown in FIG. 4 as positioned so that one end of the hairpin extends through an opening such as **9*g* shown in FIG. 6 which discloses the part 5** in enlarged condition.

The pin 8 is intended to non-rotatably connect the bar with the support 5 thereon.

The supports 5 and 6 in turn are equipped with identical handle units designated 9 and 10, the device 9 being used for descriptive purposes and shown as including rod **9*a* at the lower portion and 9*b* at the upper portion connected at their respective ends to a handle element 9*c***.

The rods **9*a* and 9*b* are entered in suitable openings formed in the support 5 and the openings are designated at 9*d* and 9*e* in FIG. 6 as being round and adapted to receive the rods 9*a* and 9*b*** respectively.

It will thus be understood that by manipulating the part **9*c*, which is pinned at the ends of the rods 9*a* and 9*b* by the pins such as 14 supplied for that purpose and intended to suitably fix the part 9*c* to the rods 9*a* and 9*b***.

The rod **9*a* is equipped at its inner end with a stop element 9*f* which will prevent the disengagement of the handle unit now being described from its mounting in the support 5**.

It will be understood that at the opposite end an identical handle unit is provided and the parts of the same entered into a corresponding part in the same manner and facilitating sliding movement of the handle parts for purposes which will appear subsequently.

Suitably fixed to the supports 5 and 6 are the fingers 11 and 12 which extend inwardly toward each other and are in alignment and upwardly spaced from the bar 4 previously referred to.

It would appear appropriate at this point to describe the manner of use of the means hereof and to that end reference is again made to FIGS. 1 and 2 wherein FIG. 2 shows the means in its entirety as positioned at one end of the sleeping bag which is denominated generally at 3.

The fingers such as 11 and 12 are positioned above the sleeping bag end in this case and the bar 4 extends below the same and is shown in dotted lines.

The handles 9 and 10 are extended in the position shown and by grasping the same, and rolling toward the user as suggested, the user's knee and leg being suggested at 13, as being positioned on the sleeping bag to be rolled up. By the manipulation as described rolling toward the user the tightness of the bag rolling action can be controlled by manipulating the handles as will be understood, pushing away if to tighten and relaxing if looser rolling is desired.

When the rolling action is completed, the handles 9 and 10 may be pushed inwardly and thus be out of the way within the bag or the unit may be removed from the rolled position by moving the pin 8, and separating the rod 4 from the handle unit 9 and support 5 of course.

Thereafter the device or means can be assembled for another rolling action as will be readily understood by those skilled in the art.

It should be clear that any similar kind of article such as a sleeping bag or tent or the like which is susceptible of being positioned as shown in FIGS. 1 and 2, may be rolled in similar fashion and the rolling means used for successive rolling operations as may be necessary or desired.

I claim:

1. Bed roll rolling apparatus comprising a main spacer bar having a longitudinal axis, finger support elements fixed at the ends of the bar, a roll starting finger extending toward each other from each element, and a handle unit mounted on each of said elements, each of said units being slidably engaged with its respective element between a retracted storage position and a use position in which the handle unit extends axially outwardly to facilitate rotation of the entire apparatus by rotating rolling action of the handle units by a user.

2. Apparatus as claimed in claim 1, wherein the handle units are slidably engaged with their respective elements, to move outwardly for use as handles, and inwardly within the apparatus out of handle use position for storage.

3. Apparatus as claimed in claim 2, wherein the handle units each include fingers which are grippable to facilitate rotation of the entire apparatus to effect rolling action thereof.

4. Apparatus as claimed in claim 1, wherein the roll starting fingers, each include a finger part fixed to a respective support element and extending inwardly toward each other.

5. Apparatus as claimed in claim 1, wherein the main spacer bar is releasably fixed at one end to a finger support element, means being provided to release said end to facilitate removal of the entire apparatus from rolling position.

6. Apparatus as claimed in claim 5, wherein the spacer bar is connected at one end, and is non-rotatably connected at another end to a finger support element, a removable pin forms the connection and removal of the pin enables separation of the bar and support element.

* * * * *